United States Patent [19]

Watanabe

[11] Patent Number: 4,962,300

[45] Date of Patent: Oct. 9, 1990

[54] PREHEATING CONTROL APPARATUS FOR DIESEL ENGINES

[75] Inventor: Kiyoshi Watanabe, Higashimatsuyama, Japan

[73] Assignee: Diesel Kiki Co., Ltd., Tokyo, Japan

[21] Appl. No.: 239,608

[22] Filed: Mar. 2, 1981

[30] Foreign Application Priority Data

Mar. 3, 1980 [JP] Japan ..... 55-26296

[51] Int. Cl.[5] ..... H05B 1/02

[52] U.S. Cl. ..... 219/497; 219/202; 219/501; 219/505; 123/179 H

[58] Field of Search ..... 313/316, 315; 123/145 A, 179 H, 179 B; 219/494, 497, 499, 505, 508, 202, 203, 501

[56] References Cited

U.S. PATENT DOCUMENTS

| | | | |
|---|---|---|---|
| 3,821,516 | 6/1974 | Hayes et al. | 219/497 |
| 3,961,236 | 6/1976 | Rodek et al. | 219/497 |
| 4,002,882 | 1/1977 | McCutchen | 219/499 |
| 4,162,379 | 7/1979 | Sebens et al. | 219/497 |
| 4,258,678 | 3/1981 | Abe | 219/497 |
| 4,322,604 | 3/1982 | Kawamura et al. | 219/497 |

*Primary Examiner*—M. H. Paschall

*Attorney, Agent, or Firm*—Pollock, Vande Sande & Priddy

[57] ABSTRACT

A preheating control apparatus for diesel engines of the present invention is provided wherein the voltage developed across a sensing resistor connected in series with a glow plug, which voltage is indicative of the temperature of the glow plug, is amplified by an amplifier. The amplified voltage is compared with a predetermined reference voltage to control the preheating current through the glow plug so that the temperature of the glow plug can be precisely controlled without increasing the resistance value of the sensing resistor.

8 Claims, 6 Drawing Sheets

LN
S
Wb
Wa
Vb
Vi
A
P
B
1
2
3
6
7
8
9
13
14
15
16
17
18
20
21
22
23
25
27
28
29
31
32
70
71
72
73
74
80
81
90
91
92
93
94
95
96
97
103

PREHEATING CONTROL APPARATUS FOR DIESEL ENGINES

The present invention relates to a preheating control apparatus for diesel engines, which controls the heating temperature of a glow plug for the purpose of preheating the combustion chamber of the engine prior to engine start.

Generally, in the starting of a diesel engine, it is required to first preheat a glow plug to a predetermined temperature. To meet this requirement, the conventional apparatus for controlling a preheating of a diesel engine is arranged to compare a reference voltage with a voltage developed across a sensing resistor connected in series with a large positive temperature coefficient glow plug which increases in ohmic value with an increase in the temperature thereof, and to control a switch positioned between the glow plug and a battery in accordance with the result of the comparison between the reference voltage and the voltage developed across the sensing resistor. Therefore, for precisely detecting the temperature of the glow plug with the conventional apparatus described above, it is necessary to increase the ohmic value of the sensing resistor, so as to obtain a larger change in the voltage thereacross with the change in the temperature of the glow plug and also to reduce the effect of dispersion of the resistance in the sensing resistor, glow plug and wiring. However, the power consumped by the sensing resistor increases when its resistance is increased, meaning that it takes longer to heat the glow plug to a predetermined temperature. Moreover, a sensing resistor with higher resistance is inevitably larger in size and more expensive. Because of these properties of the sensing resistor, it is difficult to design an apparatus which satisfies both the requirement for precise operation and the requirement for low power consumption.

It is, therefore, one object of the present invention to provide an improved preheating control apparatus for diesel engines.

It is another object of the present invention to provide a preheating control apparatus for diesel engines, which apparatus is able to precisely control the temperature of glow plugs without wasting the energy of the power source.

It is still another object of the present invention to provide a preheating control apparatus for diesel engines, which apparatus can be operated in stable condition even if the voltage of the power source is changed.

It is a further object of the present invention to provide a preheating control apparatus for diesel engines, which apparatus is able to protect glow plugs from damage due to the disconnection or short-circuitry of connecting wires.

In accordance with this invention, a preheating control apparatus for diesel engines is provided wherein the voltage developed across a sensing resistor connected in series with a glow plug, which voltage is indicative of the temperature of the glow plug, is amplified by an amplifier. The amplified voltage is compared with a predetermined reference voltage to control the preheating current through the glow plug so that the temperature of the glow plug can be precisely controlled without increasing the resistance value of the sensing resistor.

Further objects and advantages of the invention will appear from the following detailed description to be read in conjunction with the accompanying drawings in which.

Figure 1:
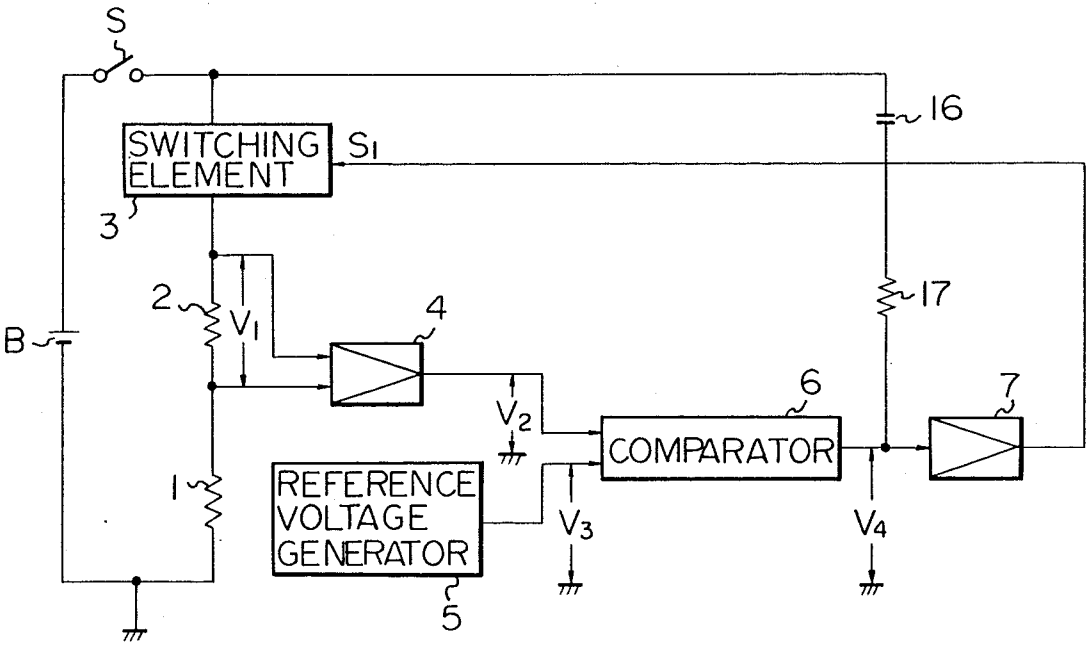
FIG. 1 is a block diagram illustrating one embodiment of the present invention.

Referring to FIG. 1 of the drawing, there is shown a block diagram of one embodiment of a preheating control apparatus for diesel engines in accordance with the present invention. The preheating control apparatus controls the preheating condition of a glow plug 1 on the basis of the change in the value of current passing through the glow plug 1, and the glow plug 1 is connected to a power source B through a series circuit including a sensing resistor 2 for detecting the amount of heating current passing through the glow plug 1, a switching element 3 and a power switch S. The glow plug 1 has such a large positive temperature coefficient, that is, its resistance is low at low temperatures but promptly increases when its temperature comes near a predetermined temperature. In order to detect whether or not the temperature of the glow plug 1 has reached a predetermined temperature on the basis of the change in its resistance due to the temperature change, a voltage $V_1$ developed across the sensing resistor 2 is applied to an amplifier 4 to be amplified by a predetermined amplification ratio, and then, the resulting output voltage $V_2$ from the amplifier 4 is applied to one input terminal of a comparator 6. On the other hand, to another input terminal of the comparator 6, a reference voltage $V_3$ produced by a reference voltage generator 5 is applied, and the level of the voltage $V_2$ is compared with that of the voltage $V_3$ in the comparator 6. The value of the voltage $V_3$ is set to be equal to the value of the output voltage $V_2$ at the time the temperature of the glow plug 1 reaches a desired preheating temperature. Therefore, the output voltage $V_4$ from the comparator 6 will be high when the voltage $V_2$ is larger than the voltage $V_3$ and will be low when the voltage $V_2$ is less than the voltage $V_3$. The output voltage $V_4$ is applied to an input terminal of another amplifier 7 and an output signal $S_1$ from the amplifier 7 is applied to the switching element 3 as a control signal. At the time the output voltage $V_4$ becomes low, the switching element is turned off to stop preheating of the glow plug 1. A capacitor 16 and a resistor 17 are used for maintaining the switching element 3 in ON condition for a predetermined period after the power switch S is turned on.

The operation of the apparatus shown in FIG. 1 will be now described. When the switch S is closed, since current for charging the capacitor 16 passes through the resistor 17, the voltage level at the input terminal of the amplifier 7 promptly rises high enough for the amplifier 7 to produce an output signal $S_1$ which turns on the switching element 3. As a result, the switching element 3 is turned on so that the current begins to flow through the glow plug 1. Once the current begins to flow through the glow plug 1, a voltage is developed across the sensing resistor 2. As the initial current is large and the resistance of the glow plugs is initially low, the voltage $V_2$ becomes larger than the voltage $V_3$, and the level of the output voltage $V_4$ can be maintained at a high level even after charging current ceases to flow to the capacitor 16. The glow plug 1 gradually increases in resistance with the increase in its temperature, whereas the magnitude of the voltage $V_1$ gradually decreases. When the temperature of the glow plug 1 reaches a predetermined preheating temperature, since the voltage $V_2$ becomes smaller than the voltage $V_3$, the voltage $V_4$ of the comparator 6 drops to turn off the switching element 3. That is, the preheating operation for the glow plug 1 is automatically ceased when the temperature of the glow plug 1 reaches a predetermined temperature.

With this circuit structure, since the voltage $V_1$ is amplified by the amplifier 4, the preheating operation can be precisely controlled even if the resistance value of the sensing resistor 2 is relatively small. Therefore, reduction of the size of the sensing resistor 2 is possible, and moreover, the glow plug can be effectively prevented from being insufficiently or excessively preheated.

Figure 2:
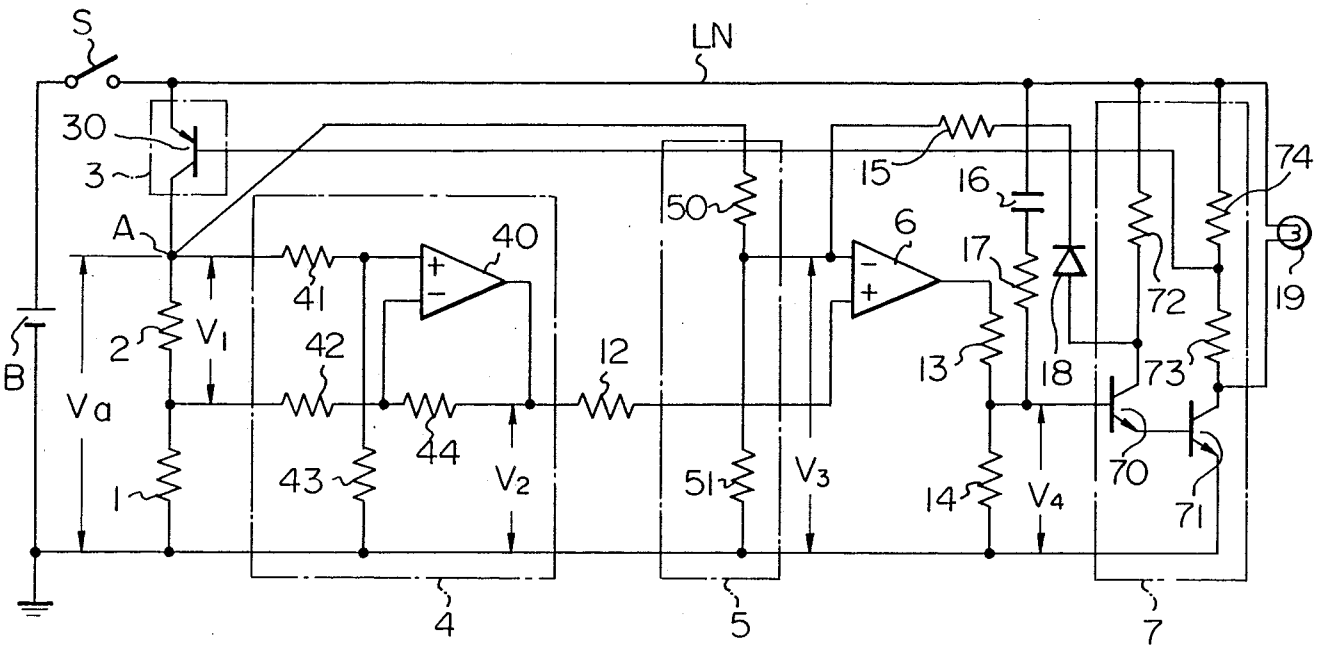
FIG. 2 is a schematic diagram of a more concrete embodiment corresponding to the apparatus shown in FIG. 1.

In FIG. 2, there is shown a schematic diagram illustrating a more concrete embodiment of the present invention, which corresponds to the block diagram shown in FIG. 1. The portions or elements of FIG. 2 corresponding to the portions or elements shown in FIG. 1 are designated by like reference symbols.

In FIG. 2, the amplifier 4 is a well known circuit composed of an operational amplifier 40 and resistors 41 to 44, and the voltage $V_1$ is applied between an inverting input terminal and a non-inverting input terminal of the operational amplifier 40 through the resistors 41 and 42. The amplified output voltage $V_2$ is derived from the output terminal of the operational amplifier 40 and the voltage $V_2$ is applied to the comparator 6 through a resistor 12. The reference voltage generator 5 is composed of resistors 50 and 51, which divide a voltage $V_a$ appearing between the point of connection A between the switching element 3 and the sensing resistor 2, and ground. The divided voltage $V_3$ appearing across the resistor 51 is applied to the comparator 6 as the reference voltage, and resultant output voltage $V_4$ is obtained by dividing the output voltage from the comparator 6 using resistors 13 and 14. The amplifier 7 is composed of transistors 70, 71 and resistors 72, 73, 74, and the voltage $V_4$ is applied to the base of the transistor 70. The voltage appearing at the connecting point between the resistor 73 and the resistor 74, which are provided in the collector circuit of the transistor 71, is applied to the base of a transistor 30 acting as the switching element 3. Therefore, when the voltage $V_4$ becomes high enough to turn on the transistors 70 and 71, the voltage level at the connection point between the resistors 73 and 74 becomes low so that the transistor 30 is turned on. On the other hand, when the voltage $V_4$ becomes low, the transistors 70 and 71 are turned off, and the transistor 30 is turned off. To indicate the ON/OFF condition of the transistor 30, a lamp 19 is provided between the collector of the transistor 71 and the positive line LN. The lamp 19 goes out when the preheating operation has been terminated.

The operation of the circuit illustrated in FIG. 2 will be hereinafter described. From the foregoing description, it will be easily understood that the transistor 30 is turned on by the charge current flowing to the capacitor 16 at the time the switch S is closed. The value of the voltage $V_1$ developed by the current flowing through the glow plug 1 can be expressed by the following equation.

$$V_1 = \frac{R_S}{R_S + R_G} \cdot V_a \tag{1}$$

in which, $R_S$ is the resistance value of the sensing resistor and $R_G$ is the resistance value of the glow plug.

Resistance values $R_{41}$, $R_{42}$, $R_{43}$ and $R_{44}$, which are the resistance values of the resistors 41 to 44, respectively, are determined so as to satisfy the following equations.

$$\frac{R_{43}}{R_{41} + R_{43}} = \frac{R_{44}}{R_{42} + R_{44}} \tag{2}$$

and $$\frac{R_{44}}{R_{42}} = K \tag{3}$$

where, K is the amplification factor of the amplifier 4.

Furthermore, the reference voltage $V_3$ can be expressed by the following equation.

$$V_3 = \frac{R_{51}}{R_{50} + R_{51}} \cdot V_a \tag{4}$$

where, $R_{50}$ and $R_{51}$ are the resistance values of resistors 50 and 51, respectively.

The value of $V_1 \cdot K$ which is K times voltage $V_1$ expressed by the equation (1) is compared with the value of $V_3$ expressed by the equation (4) by the comparator 6 and the switching element 3 is controlled in accordance with the result of the comparison.

That is, the condition under which the switching element 3 is in OFF state is as follows:

$$K \cdot \frac{R_S}{R_S + R_G} \cdot V_a < \frac{R_{51}}{R_{50} + R_{51}} \cdot V_a \tag{5}$$

Therefore, the inequality (5) can be expressed as follows:

$$R_G > R_S \cdot \left( \frac{R_{50} + R_{51}}{R_{51}} \cdot K - 1 \right) \tag{6}$$

As can be understood from the inequality (6), the condition under which the switching element is turned off does not depend upon the value of voltage $V_a$. Therefore, the operation of this circuit is not directly affected by a change in the power source voltage. Moreover, it can also be understood from the inequality (6) that current flow through the glow plug is always discontinual when the resistance of the glow plug reaches a predetermined value independently of the magnitude of the voltage drop produced at the switching element 3 or the value of the resistance of the wire between the power source B and the switching element 3. Therefore, the preheating of the glow plug can be precisely controlled.

To prevent the output voltage of the comparator 6 from becoming high again when the switching element 3 is turned off, the voltage appearing on the collector of the transistor 70 is applied to the minus terminal of the comparator 6 through a resistor 15 and a diode 18 instead of the voltage $V_3$. Therefore, when the collector of transistor 70 is in OFF condition, the diode 18 is biased in the reverse direction so that the comparator 6 carries out the comparing operation as described above. However, once the transistor 70 is turned on, the high voltage appearing on the collector of the transistor 70, which is almost equal to the power source voltage, is applied to the minus input terminal of the comparator 6 so that the output voltage $V_4$ is maintained at a high level regardless of the disappearance of the voltage $V_a$.

Figure 3:
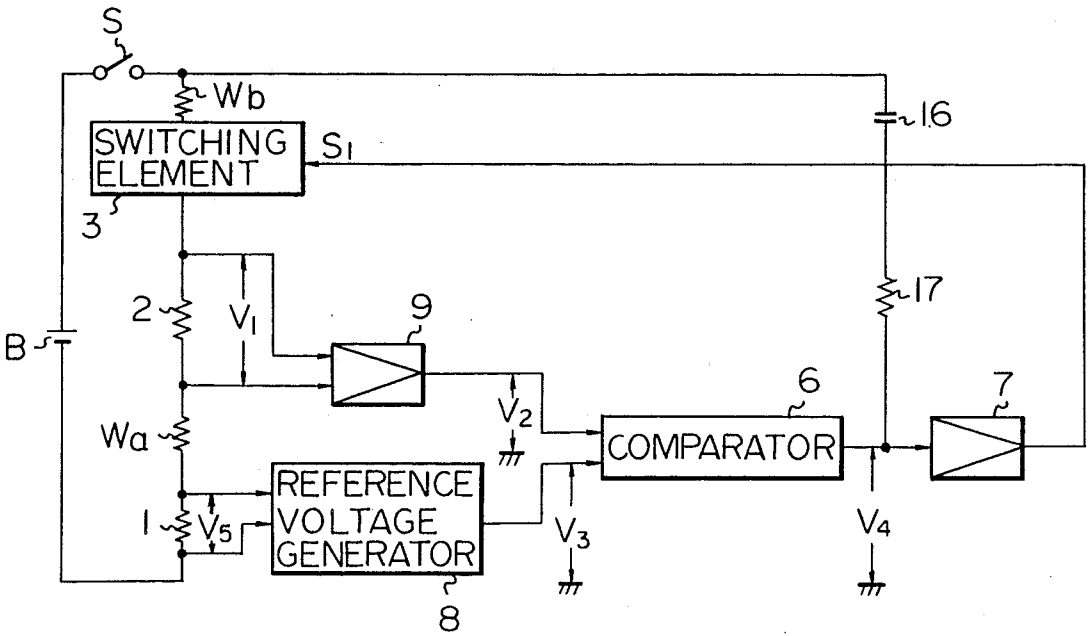
FIG. 3 is a block diagram illustrating another embodiment of the present invention.

Referring to FIG. 3, there is shown another embodiment of the present invention. The apparatus shown in FIG. 3 is different from the apparatus shown in FIG. 1 in that a reference voltage generator 8 is arranged so as to generate the reference voltage on the basis of a voltage $V_5$ developed across the glow plug 1. The voltage $V_2$ to be compared with the reference voltage $V_3$, is obtained by amplifying the voltage $V_1$ developed across the sensing resistor 2 by an amplifier 9 in a similar way to that in the embodiment of FIG. 1. In FIG. 3, the portions or elements corresponding to that of FIG. 1 are designated by the same reference symbols. Reference symbols $W_a$ and $W_b$ represent the resistances of the connecting wires (wiring resistances). When the reference voltage $V_3$ is produced on the basis of the voltage $V_5$ developed across the glow plug 1, the effects due to the wiring resistances $W_a$, $W_b$ of the connecting wires can be eliminated so that more precise preheating control can be carried out.

The reasons for this will now be explained with reference to a more concrete embodiment of the present invention illustrated in FIG. 4 wherein like reference symbols denote corresponding portions or elements to those in FIGS. 1, 2 and 3.

The reference voltage generator 8 is composed of resistors 80 and 81 connected in series, and the reference voltage $V_3$ is produced by dividing the voltage $V_5$ by the series circuit comprised of the resistors 80 and 81. Therefore, the reference voltage $V_3$ is expressed by the following equation.

$$V_3 = \frac{R_{81}}{R_{80} + R_{81}} \cdot V_5 \tag{7}$$

wherein $R_{80}$ and $R_{81}$ are the resistance values of the resistors 80 and 81, respectively.

The amplifier 9 is a well-known circuit, per se, composed of operational amplifiers 90 and 91, resistors 92 to 96 and a variable resistor 97. When the terminal voltage of the power source B is shown by $V_b$, the voltage $V_1$ is expressed as follows:

$$V_1 = \frac{R_S \cdot V_b}{R_{W1} + R_Q + R_S + R_{W2} + R_G} \tag{8}$$

wherein, $R_{W1}$: value of the wiring resistance $W_a$ $R_{W2}$: value of the wiring resistance $W_b$ $R_Q$: equivalent resistance of the switching element 3 in its ON condition.

As will be understood from the equation (8), the value of the voltage $V_1$ decreases with the increase in the temperature of the glow plug 1. The voltage $V_1$ is multiplied by L times in the amplifier 9 in which a differential amplifier is arranged by the use of the operational amplifier 90 and the operational amplifier 91 acting as a non-inverting amplifier. For this, the resistance values $R_{92}$ to $R_{95}$ of the resistors 92 to 95 are determined so as to satisfy the following relationship.

$$\frac{R_{94}}{R_{92} + R_{94}} = \frac{R_{95}}{R_{93} + R_{95}} \tag{9}$$

The amplification ratio of the amplifier 9 can be set to a desired value by adjusting the value of the variable resistor 97.

On the other hand, from the equation (7), the reference voltage $V_3$ may be expressed as follows:

$$V_3 = \frac{R_G V_B}{R_{W1} + R_Q + R_S + R_{W2} + R_G} \times \frac{R_{81}}{R_{80} + R_{81}} \tag{10}$$

The switching element 3 is also controlled according to the results of a comparison of the voltage $V_2$ with the voltage $V_3$ in the comparator 6, in a similar way to the operation of the foregoing embodiment.

The condition whereunder the current flowing through the glow plug is stopped is as follows:

$$L \cdot V_1 < V_3 \tag{11}$$

The following condition can be obtained by substituting the equations (8) and (10) therein.

$$R_G > \frac{L\, R_S (R_{80} + R_{81})}{R_{81}} \tag{12}$$

It will be understood from the inequality (12) that the condition of cutting off the preheating current does not depend upon the voltage $V_b$ or the resistance values $R_{W1}$, $R_{W2}$ and $R_Q$. As a result, it follows that the current flowing through the glow plug is stopped regardless of any change in the power source voltage and the value of the wiring resistance or the resistance of the switching element when the resistance value of the glow plug becomes a predetermined value. Therefore, stable operation can be attained and over preheating or insufficient preheating can be completely avoided so that melting or other damage of the glow plug and failure of the starting operation can be avoided. Furthermore, since any dispersion in the resistance of the sensing resistor that may exist can be easily compensated for by adjusting the amplification ratio L of the amplifier 9, it is not necessary to carry out severe quality control of the resistance of the sensing resistor. As a result, the cost of producing the sensing resistor can be easily reduced.

Figure 5:
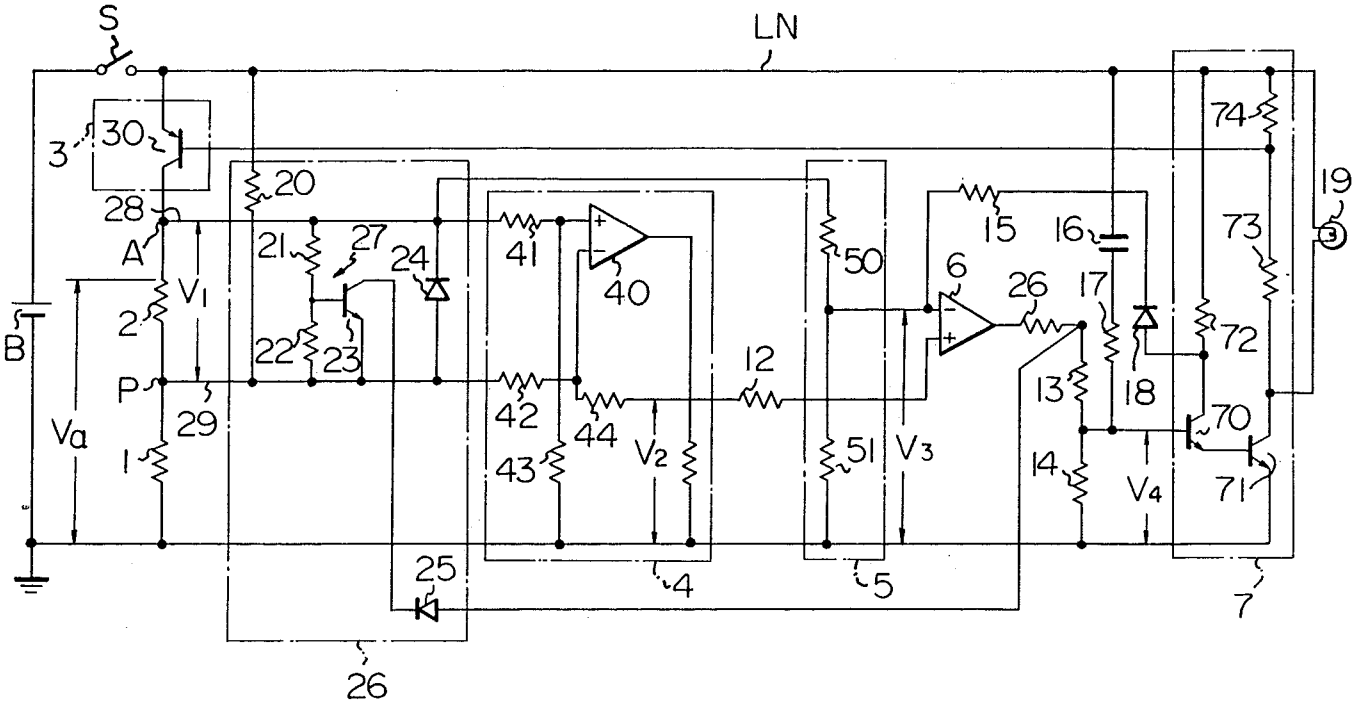
FIG. 5 is a schematic diagram of still another embodiment of the present invention.

FIG. 5 illustrates still another embodiment of the present invention, which corresponds to an apparatus wherein a protection circuit is provided at the input portion of the amplifier 4 in the apparatus shown in FIG. 2. The protection circuit 26 protects the apparatus and prevents the apparatus from error due to disconnection or the like. The protection circuit 26 comprises a protection resistor 20 connected between one end of the resistor 42 and one end of the switch S, a short detecting circuit 27 composed of resistors 21, 22 and a transistor 23 and a diode 24 which is connected in parallel to the input portion of the amplifier 4 and which prevents the glow plug from overheating or melting due to the disconnection of the wire 28. When a wire 29 connecting an input terminal of the amplifier 4 to a point P is disconnected from the point P, the potential at the input terminal of the amplifier 4 is increased by the protection resistor 20. As a result, the output level of the amplifier 4 becomes less than the reference voltage $V_3$ so that the current flowing through the glow plug 1 can be cut off. Therefore, even if the wire 29 is disconnected or is broken due to vibration or the like, since it is possible to prevent the ON condition in the switching element from maintaining, the melting of the glow plug 1 can be precluded.

The short detecting circuit 27 is a circuit wherein the voltage $V_1$ is divided by the series circuit comprised of the resistors 21 and 22 and the divided voltage is applied to the transistor 23 as a base bias voltage. The collector of the transistor 23 is connected to the connection point between the resistors 26 and 13 through a diode 25. If the apparatus is operated in normal condition, the voltage $V_1$ is so small that the transistor 23 is in OFF condition, and the diode 25 is biased in the reverse direction. However, if for some reasons, for example, when the point P is connected to ground and the potential at point P assumes ground level, the level of the voltage $V_1$ is increased to turn on the transistor 23. As a result, the diode 25 is then biased in the forward direction and the input level of the amplifier 7 drops and the switching element 3 is turned off. The sensing resistor 2 and/or the switching element 3 are thus protected from burning out.

The diode 24 is provided for the purpose of preventing the glow plug from burning out when the connecting wire 28 is disconnected from the poin A or is broken and the switching element 3 is kept in ON condition. In the case that the diode 24 is connected as shown in FIG. 5, since the current is passed from the power source into the reference voltage generator 5 through the diode 24 when, for example, the wire 28 is broken, the output level of the amplifier 4 becomes low. On the other hand, due to the current supplied from the diode 24, the level of the reference voltage $V_3$ produced by the reference voltage generator 5 is dicreased only by the sum of the voltage drop in the diode 24 and the voltage drop in the sensing resistor 2. As described above, if the diode 24 is inserted therein, since the condition of $V_3 > V_2$ can be maintained at the time a trouble occurs in the wire, it is possible to stop the preheating operation of the glow plug 1 by turning off the switching element 3.

With the protection circuit 26, the melting or malfunction of the glow plug which would otherwise be caused by a problem arising in the wire connecting the sensing resistor 2 to the circuit can be prevented by means of a simple circuit structure.

Figure 4:
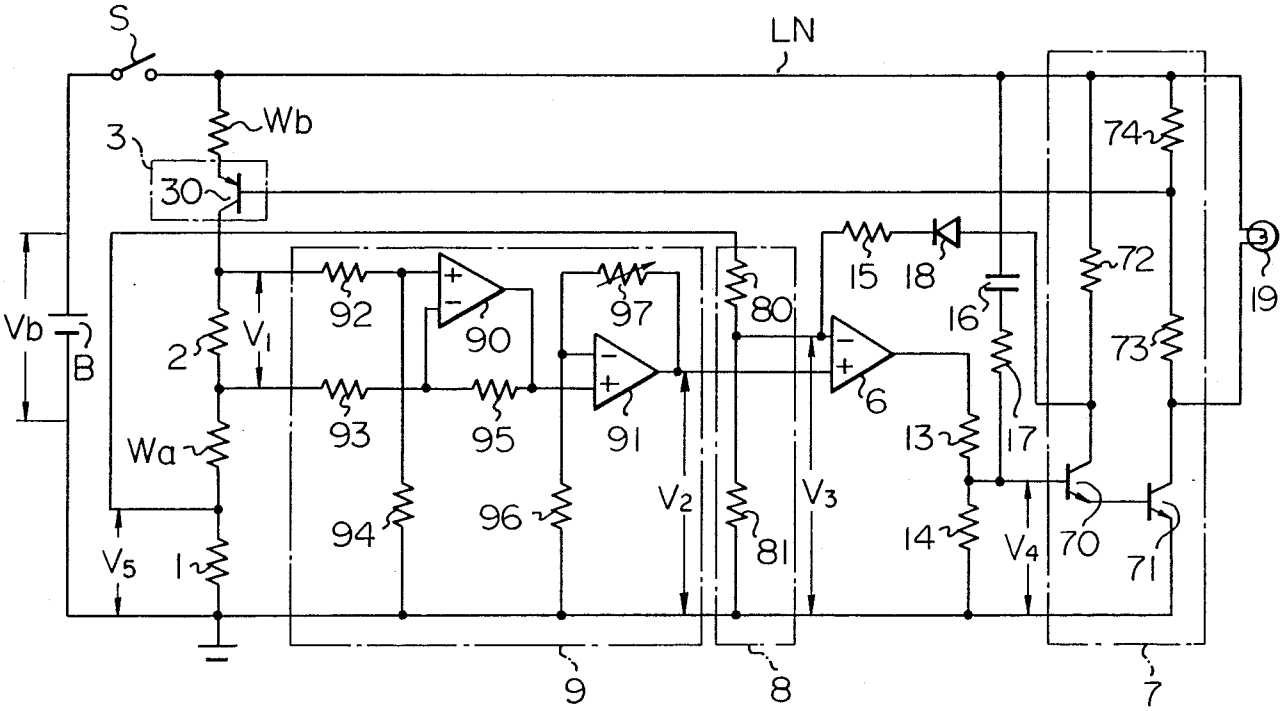
FIG. 4 is a schematic diagram of a more concrete embodiment corresponding to the apparatus shown in FIG. 3.
Figure 6:
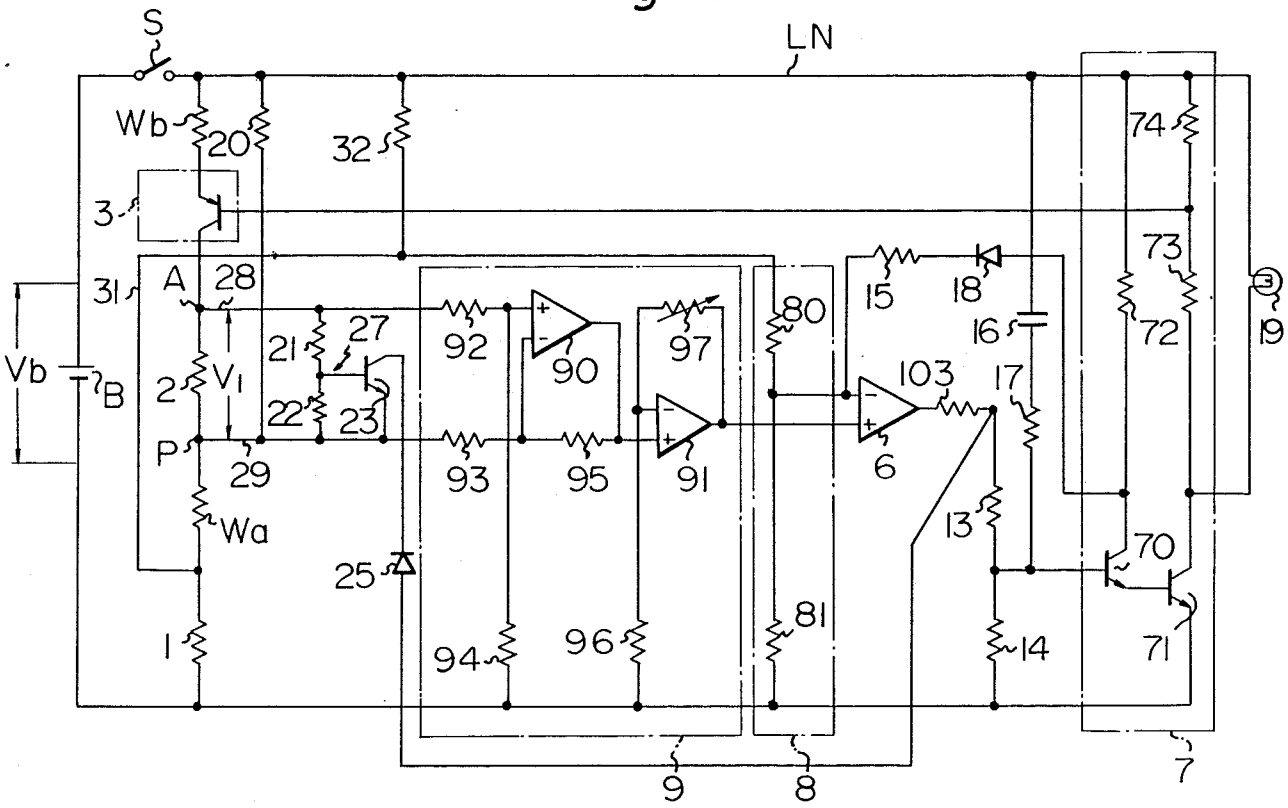
FIG. 6 is a schematic diagram of a still further embodiment of the present invention.

FIG. 6 illustrates another apparatus according to the present invention, in which another protection circuit is incorporated into the apparatus shown in FIG. 4. The apparatus of FIG. 6 is provided with the short detecting circuit 27 and a resistor 32, and the short detecting circuit 27 composed of the protection resistor 20, resistors 21, 22, transistor 23 and diode 25 operates in a similar way to that of FIG. 5.

The resistor 32 is provided for the purpose of preventing the switching element 3 from remaining in ON state by preventing a voltage from being supplied to the reference voltage generator 8 when a wire 31 becomes disconnected from the terminal of the glow plug 1 or is broken. When the wire 31 is disconnected or broken, the reference voltage $V_3$ rises and the switching element 3 is turned off. Therefore, the glow plug 1 can be effectively protected from burning out by excessive heating. Since a resistor having greater resistance than that of any of $R_S$, $R_{W1}$, $R_{W2}$ and $R_2$ is used as resistor 32, this resistor has no effect on circuit operation under normal conditions.

I claim:

1. A preheating control apparatus for diesel engines, which controls the preheating of a glow plug having a predetermined resistance-temperature coefficient, comprising:

a resistor connected in series with said glow plug;

means for amplifying a voltage developed across said resistor;

means for generating a reference voltage;

means for comparing the output level of said amplifying means with the level of said reference voltage; and a switching means for controlling a current supplied to said glow plug on the basis of the result of the comparison in said comparing means, said reference voltage generating means producing said reference voltage on the basis of the potential develped across said glow plug; and a protection circuit means for turning off said switching means in response to the occurrence of an abnormal change in the magnitude of the voltage in the circuit including said glow plug and said resistor, said protection circuit means being provided on the input side of said amplifying means.

2. A preheating control apparatus for diesel engines as claimed in claim 1 wherein said protection circuit means has a detecting circuit means responsive to an excess in the voltage applied to the input of said amplifying means over a predetermined voltage and means for turning off said switching means in accordance with the output from said detecting circuit means.

3. A preheating control apparatus for diesel engines as claim in claim 2 wherein said protection circuit means has a protection resistor connected between a power source line and one input terminal of said amplifying means whereby the output level of said amplfying means is decreased when the one input terminal is disconnected from the circuit of the glow plug.

4. A preheating control apparatus for diesel engines as claimed in claim 1 wherein said protection circuit means has a diode conntected between the input terminals of said amplifying means and said reference voltage generating means has a series resistor circuit for dividing the voltage appearing at the cathode of said diode.

5. A preheating control apparatus for diesel engines, which controls the preheating or a glow plug having a predetermined resistance-temperature coefficient, comprising:

a resistor connected in series with said glow plug;

means for amplifying a voltage developed across said resistor;

means for generating a reference voltage of a predetermined level;

means for comparing the output level of said amplifying means with the level of said reference voltage; and a switching means for controlling a current supplied to said glow plug on the basis of the result of the comparison in said comparing means; wherein said reference voltage generating means includes a resistor circuit for dividing the potential at one input terminal of said amplifying means; and a protection circuit means for turning off said switching means in response to the occurrence of an abnormal change in the magnitude of the voltage in the circuit including said glow plug and said resistor, said protection circuit means being provided on the input side of said amplifying means.

6. A preheating control apparatus for diesel engines as claimed in claim 5 wherein said protection circuit means has a detecting circuit means responsive to an excess in the voltage applied to the input of said amplifying means over a predetermined voltage and means for turning off said switching means in accordance with the input from said detecting circuit means.

7. A preheating control apparatus for diesel engines as claimed in claim 6 wherein said protection circuit means has a protection resistor connected between a power source line and one input terminal of said amplifying means whereby the output level of said amplifying means is decreased when the one input terminal is disconnected from the circuit of the glow plug.

8. A preheating control apparatus of diesel engines as claimed in claim 5 wherein said protection circuit means has a diode connected between the input terminals of amplifying means and said reference voltage generator has a series resistor circuit for dividing the voltage appearing at the cathode of said diode.

* * * * *